US006719527B2

(12) United States Patent
Collins

(10) Patent No.: US 6,719,527 B2
(45) Date of Patent: Apr. 13, 2004

(54) TIP TREATMENT BAR COMPONENTS

(75) Inventor: Larry Collins, Monmouthshire (GB)

(73) Assignee: Rolls-Royce plc, London (GB)

( * ) Notice: Subject to any disclaimer, the term of this patent is extended or adjusted under 35 U.S.C. 154(b) by 90 days.

(21) Appl. No.: 10/085,098

(22) Filed: Mar. 1, 2002

(65) Prior Publication Data

US 2002/0122726 A1 Sep. 5, 2002

(30) Foreign Application Priority Data

Mar. 5, 2001 (GB) ..... 0105391

(51) Int. Cl.[7] ..... F01D 25/04
(52) U.S. Cl. ..... 415/173.1
(58) Field of Search ..... 415/57.4, 58.7, 415/59.1, 108, 119, 173.1, 914

(56) References Cited

U.S. PATENT DOCUMENTS 4,239,452 A 12/1980 Roberts, Jr.
5,308,225 A * 5/1994 Koff et al. ..... 415/57.4
5,474,417 A * 12/1995 Privett et al. ..... 415/173.1
6,409,470 B2 * 6/2002 Allford et al. ..... 415/119
6,497,551 B1 * 12/2002 Hand et al. ..... 415/173.1
6,514,039 B1 * 2/2003 Hand ..... 415/119
2002/0122718 A1 * 9/2002 Motherwell et al. ..... 415/119
2002/0122719 A1 * 9/2002 Clark ..... 415/119
2002/0122721 A1 * 9/2002 Collins ..... 415/173.1

FOREIGN PATENT DOCUMENTS

GB 2 356 588 A 5/2001
WO WO 94/20759 9/1994

* cited by examiner

*Primary Examiner*—Edward K. Look
*Assistant Examiner*—Richard A. Edgar
(74) *Attorney, Agent, or Firm*—Oliff & Berridge, PLC

(57) ABSTRACT

A tip treatment bar component (16) for positioning within an annular cavity surrounding a fan (4) within a gas turbine engine comprises a longitudinal portion (30) with a platform (32, 34) at each end. The platforms (32, 34) of adjacent bars (16) abut each other laterally to provide a slot (28) between adjacent tip treatment bar components (16). A projection, for example a tang (24, 26), extends from the platforms (32, 34) in a direction away from the longitudinal portion (30) of the tip treatment component (16). This serves to locate the bar component (16) in the engine casing (2).

16 Claims, 4 Drawing Sheets

TIP TREATMENT BAR COMPONENTS

FIELD OF THE INVENTION

This invention relates to tip treatment bars of a rotor casing for a gas turbine engine.

BACKGROUND OF THE INVENTION AND PRIOR ART

WO94/20759 discloses an anti-stall tip treatment means in a gas turbine engine, in which an annular cavity is provided adjacent the blade tips of a compressor rotor. The cavity communicates with the gas flow path through the compressor through a series of slots defined between solid tip treatment bars extending across the mouth of the cavity.

Such tip treatments are applicable to both fans and compressors of gas turbine engines, and their purpose is to improve the blade stall characteristics or surge characteristics of the compressor.

Known tip treatments comprise an annular assembly made up of a plurality of segments in which the slots are formed. These segments are provided with tangs which cooperate with slots in the engine casing to hold the segments in position. The assembly may have more than 100 milled slots, and consequently manufacture is expensive and it is difficult to meet the required tolerances.

Experience has shown that tip treatment bars as described above are likely to exhibit cracking due to vibration. This is initiated by the rotor blades as they pass the bars and the subsequent interaction between adjacent bars as they are connected to one another. The proportions of the slots, including their depth and spacing, together with the depth of the annular cavity are aerodynamically important. Analysis of the above arrangement shows a conflict between the mechanical and aerodynamic optimum designs such that either one or the other must be compromised.

An object of the present invention is to avoid cracking of tip treatment bars as a result of vibration. Another object of the present invention is to reduce vibrational coupling between adjacent tip treatment bars.

A further object of the present invention is to provide a tip treatment assembly in which tip treatment bars are installed as separate components.

SUMMARY OF THE INVENTION

According to the present invention there is provided a tip treatment bar component for a gas turbine engine, the component having a longitudinal portion and a platform on at least one end of the longitudinal portion, the platform extending laterally to at least one side of the longitudinal portion.

The platform may extend laterally on opposite sides of the longitudinal portion of the tip treatment bar.

In a preferred embodiment, a platform is provided at each end of the longitudinal portion, in which case the platforms may further be connected by a support which is spaced from the longitudinal portion.

A projection, for example in the form of a tang, may extend from the or each platform in a direction away from the longitudinal portion. The projections serve to locate the bar components in an engine casing.

When installed in an engine casing, the bar components form an annular array in which the platforms of adjacent bar components abut each other to maintain spacing between the longitudinal portions. If the bar components include tangs, these extend circumferentially of the array, and may abut adjacent tangs to form a circumferential rib. As the bar components in the array are not rigidly connected to one another, the vibration characteristics of the array are improved. Further, mechanical analysis of the structure is simplified as the bar components are not coupled, and a mechanical solution for the structure is easier to obtain.

DETAILED DESCRIPTION OF PREFERRED EMBODIMENTS

Figure 1:
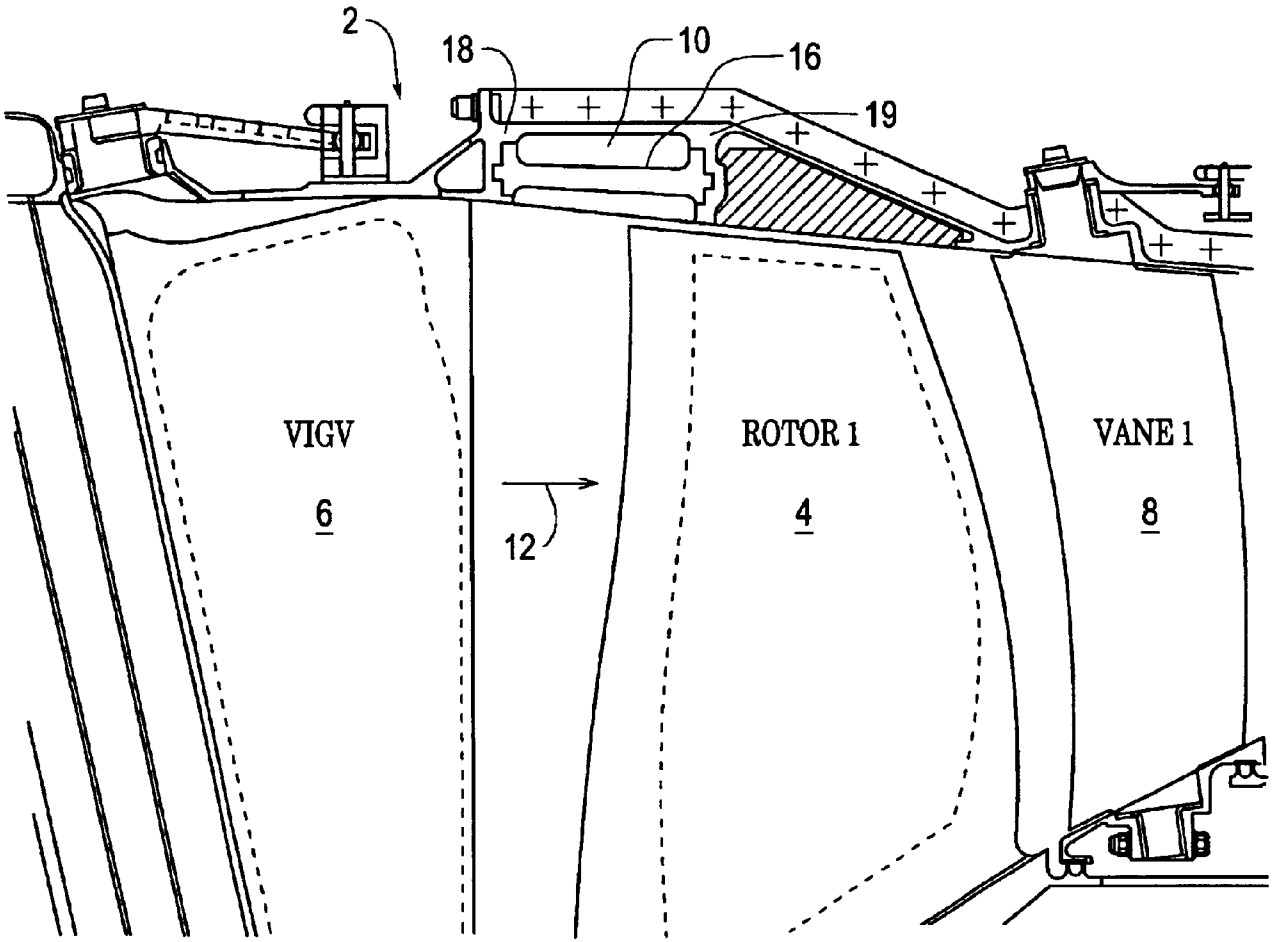
FIG. 1 is a partial axial sectional view of a fan stage in a gas turbine engine.

FIG. 1 represents a fan casing 2 of a gas turbine engine. A fan, represented by a single blade 4, is mounted for rotation in the casing 2. Guide vanes 6 and 8 are provided upstream and downstream, respectively, of the fan 4. The casing 2 includes a circumferentially extending chamber 10, which communicates with the main gas flow through the fan (represented by an arrow 12) through an array of slots 28 (see FIG. 2) defined between longitudinal portions 30 of tip treatment bar components 16 disposed around the casing 2. The function of the chamber 10 in delaying the onset of stalling of the blades 4 is disclosed in International Patent Publication WO94/20759.

As shown in FIG. 1, the casing 2 includes annular front and rear end supports 18, 19 which support the bar components 16 to provide a tip treatment ring which extends around the fan 4. The front and rear supports 18, 19 are integral with the casing 2.

Figure 2:
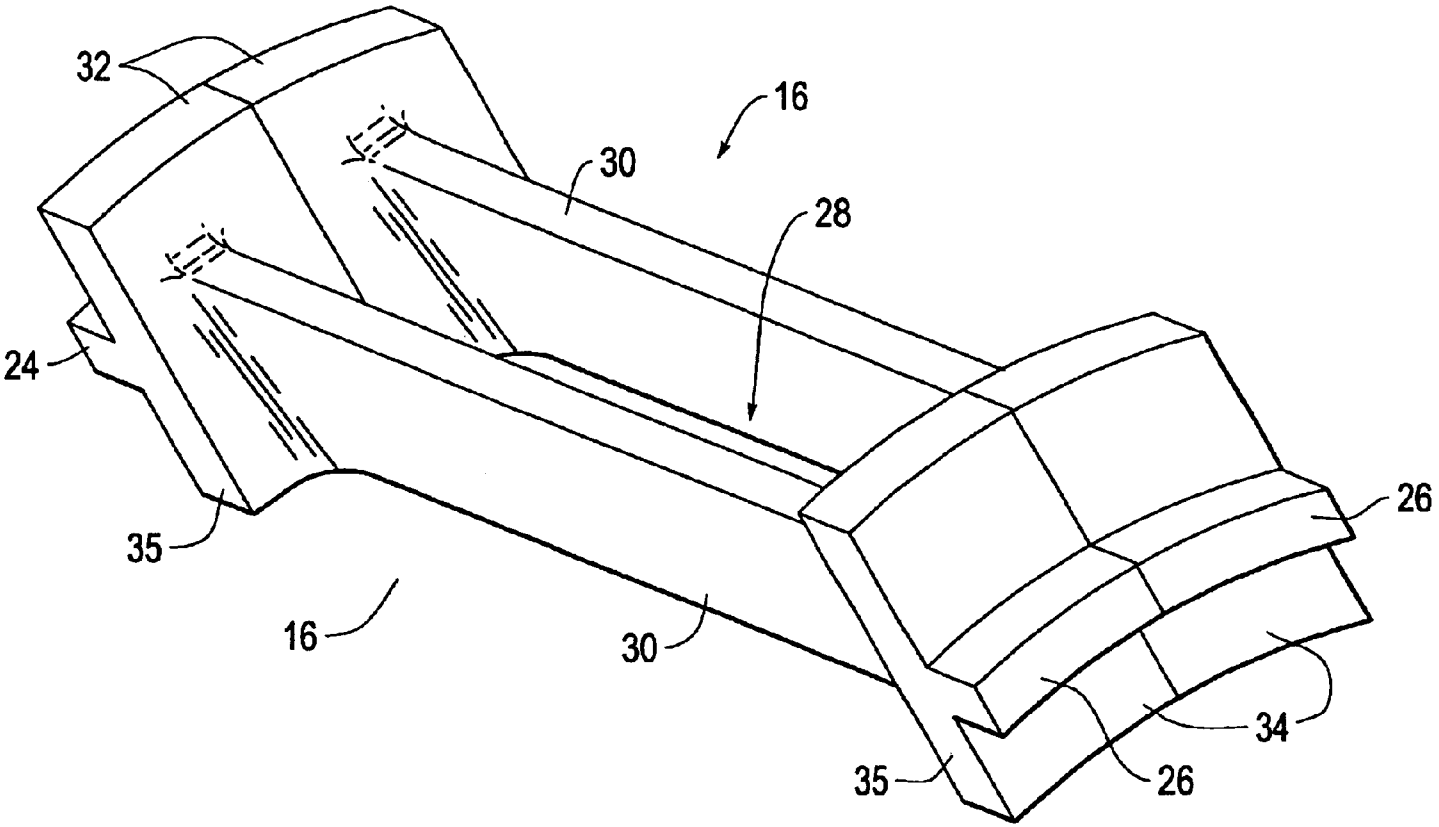
FIG. 2 is a view of two adjacent tip treatment bar components in the engine of FIG. 1.

The bar components may be machined from bar or forgings. They are, for example, made from a suitable alloy. As shown in FIG. 2, each tip treatment bar component 16 comprises a longitudinal portion 30 with platforms 32, 34 at each end extending laterally on opposite sides of the longitudinal portion. Projections in the form of tangs 24,26 extend from the platforms 32, 34. As shown in FIG. 1, these tangs 24, 26 are located within an annular channel in the supports 18,19 respectively.

The bar components 16 are located adjacent to one another within the annular supports 18,19 to form a slot 28 (FIG. 2). The platforms 32, 34 have planar side surfaces 35 which abut one another. The width of the slot 28 is determined by the width of the platforms 32,34 between their side surfaces 35, and the width of the longitudinal portion 30.

Figure 3:
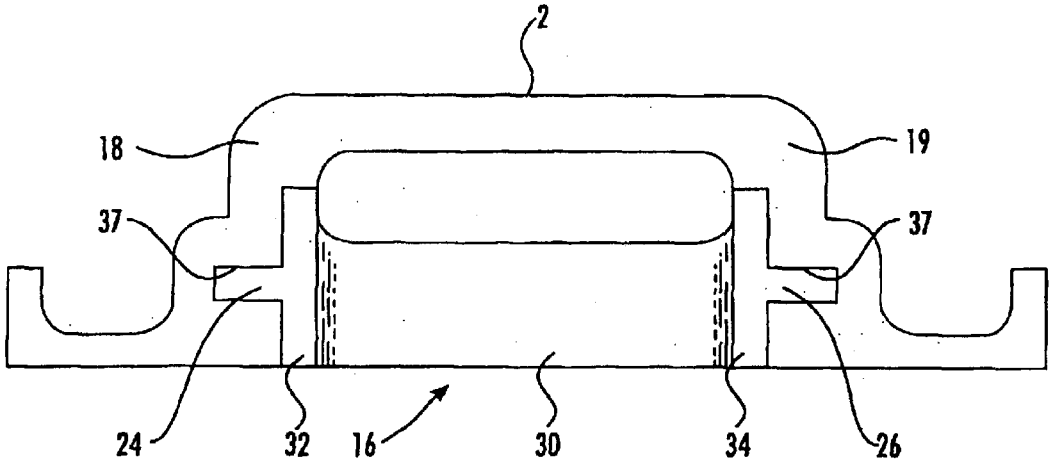
FIG. 3 shows the bar components of FIG. 2 assembled in an engine casing.

FIG. 3 shows a tip treatment bar component 16 of FIG. 2 installed within the supports 18, 19. The tangs 24, 26 are located within annular channels 37 in the supports 18, 19. The tangs 24, 26 respectively abut one another to provide a continuous circumferential rib disposed in the channels 37. The circumferentially extending chamber 10 is defined by the casing 2, the supports 18, 19 and the tip treatment bar components 16. The circumferentially extending chamber 10 communicates with the main gas flow through a plurality of slots 28 defined between adjacent longitudinal portions 30.

Figure 4:
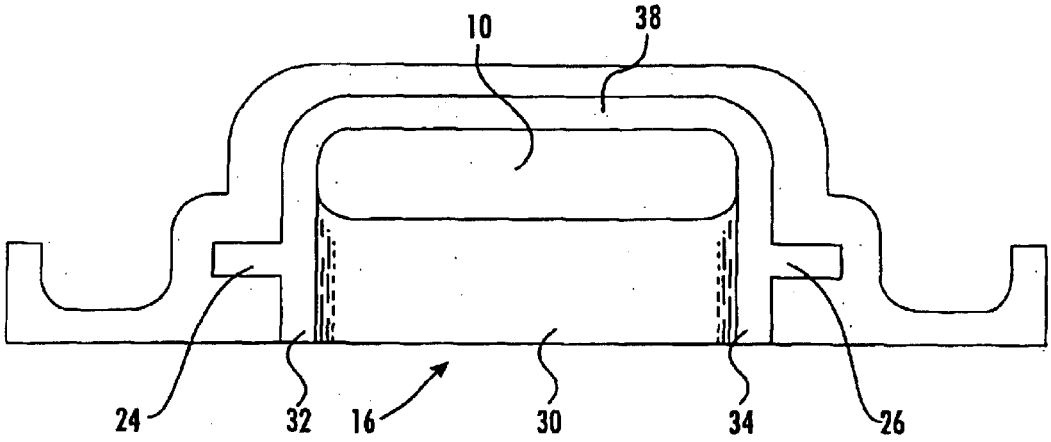
FIG. 4 corresponds to FIG. 3 but shows an alternative embodiment of the bar components.
Figure 5:
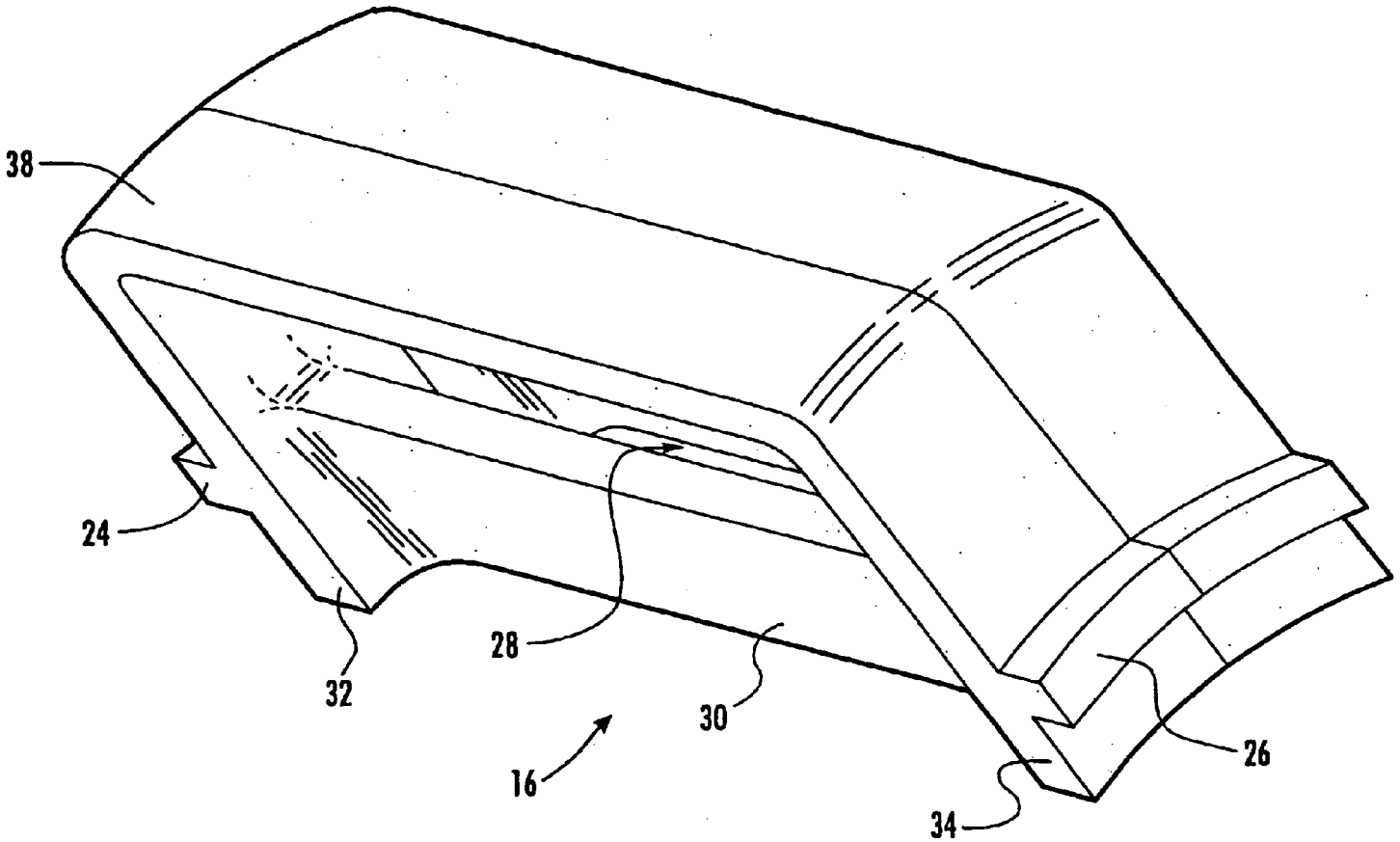
FIG. 5 shows two adjacent bar components of the embodiment of FIG. 4.

In FIGS. 4 and 5 show an alternative embodiment. The tip treatment bar component 16 includes platforms 32, 34 extending laterally from the longitudinal portion 30. Tangs 24, 26 extending away from the longitudinal portion 30 are provided on the outer faces of the platforms 32, 34. In the embodiment of FIGS. 4 and 5, a support 38 is also provided which connects the platform portions 32, 34 and is spaced from the longitudinal portion 30. Thus, the circumferentially extending chamber 10 is defined by the support 38 and bar component 30.

What is claimed is:

1. A tip treatment bar component for a gas turbine engine, the bar component comprising:

a longitudinal portion having opposite ends;

a platform on at least one end of the longitudinal portion, the platform extending laterally to at least one side of the longitudinal portion.

2. A tip treatment bar component as claimed in claim 1, wherein the platform extends laterally on opposite sides of the longitudinal portion.

3. A tip treatment bar component as claimed in claim 1, wherein a said platform is provided at both ends of the longitudinal portion.

4. A tip treatment bar component as claimed in claim 3, wherein the platforms are connected to each other by a support which is spaced from the longitudinal portion.

5. A tip treatment bar component as claimed in claim 1, further comprising a locating projection extending from the platform in a direction away from the longitudinal portion.

6. A tip treatment bar component as claimed in claim 5, wherein the projection is a tang.

7. A tip treatment bar component as claimed in claim 1, wherein the platform is formed integrally with the longitudinal portion.

8. A tip treatment bar component as claimed in claim 7, wherein the platform extends laterally on opposite sides of the longitudinal portion.

9. A tip treatment bar component as claimed in claim 7, wherein a said platform is provided at both ends of the longitudinal portion.

10. A tip treatment bar component as claimed in claim 9, wherein the platforms are connected to each other by a support which is spaced from the longitudinal portion.

11. A tip treatment bar component as claimed in claim 7, further comprising a locating projection extending from the platform in a direction away from the longitudinal portion.

12. A tip treatment bar component as claimed in claim 11, wherein the projection is a tang.

13. A tip treatment assembly comprising an annular array of tip treatment bar components, each bar component comprising:

a longitudinal portion having opposite ends;

a platform on at least one end of the longitudinal portion, the platform extending laterally to at least one side of the longitudinal portion, the platforms of adjacent bar components abutting each other to maintain spacing between the longitudinal portions of the bar components.

14. A tip treatment assembly as claimed in claim 13, in which a projecting tang is provided on the face of each platform directed away from the longitudinal portion, the tangs of adjacent bar components abutting each other to form a rib extending circumferentially of the array.

15. A tip treatment assembly as claimed in claim 13, in which said platform is provided at both ends of the longitudinal portion, the platforms of each bar component being connected to each other by a support which is spaced from the longitudinal portion of the respective bar component, the supports of adjacent bar components abutting each other to provide a casing which surrounds the longitudinal portions of the array of bar components.

16. In a gas turbine engine, a tip treatment assembly comprising:

oppositely disposed annular supports, each having an annular channel;

an annular array of tip treatment bar components extending between the annular supports, each bar component comprising:

a longitudinal portion having opposite ends;

a platform on at least one end of the longitudinal portion, the platform extending laterally to at least one side of the longitudinal portion; and a projecting tang extending from the or each platform in a direction opposite the longitudinal portion the platforms of adjacent bar components abutting each other to maintain spacing between the longitudinal portions of the bar components, and the projecting tangs engaging the respective channels in the annular supports.

* * * * *